US005331936A

United States Patent [19]

Messih et al.

[11] Patent Number: 5,331,936

[45] Date of Patent: Jul. 26, 1994

[54] METHOD AND APPARATUS FOR INFERRING THE ACTUAL AIR CHARGE IN AN INTERNAL COMBUSTION ENGINE DURING TRANSIENT CONDITIONS

[75] Inventors: Isis A. Messih, Troy; Lawrence H. Buch, Farmington Hills; Michael J. Cullen, Northville, all of Mich.

[73] Assignee: Ford Motor Company, Dearborn, Mich.

[21] Appl. No.: 16,322

[22] Filed: Feb. 10, 1993

[51] Int. Cl.[5] ..... F02M 51/00

[52] U.S. Cl. ..... 123/480; 123/488

[58] Field of Search ..... 123/488, 480, 492, 493, 123/417, 422, 423, 588; 73/118.2

[56] References Cited

U.S. PATENT DOCUMENTS

| | | | |
|---|---|---|---|
| 3,906,207 | 9/1975 | Rivere et al. | 123/486 |
| 4,562,814 | 1/1986 | Abo et al. | 123/492 |
| 4,870,937 | 10/1989 | Sanbuichi et al. | 123/488 |
| 4,957,088 | 9/1990 | Hosaka | 123/488 |
| 4,976,243 | 12/1990 | Sano et al. | 123/492 |
| 5,012,422 | 4/1991 | Takahashi et al. | 73/118.2 |
| 5,136,517 | 8/1992 | Cullen et al. | 73/118.2 |
| 5,174,264 | 12/1992 | Matsuoka et al. | 123/488 |
| 5,228,336 | 7/1993 | Nagaishi | 123/488 |

*Primary Examiner*—E. Rollins Cross
*Assistant Examiner*—Thomas N. Moulis
*Attorney, Agent, or Firm*—Roger May; Peter Abolins

[57] ABSTRACT

A mass airflow based control system for an internal combustion engine is provided which is capable of inferring cylinder air charge during non-steady state periods of operation of the engine. The control system infers cylinder air charge from values of rotational engine speed, air mass flow inducted into the engine, inlet air temperature, engine coolant temperature, and barometric pressure. The control system employs the inferred cylinder air charge value for air/fuel ratio control.

21 Claims, 4 Drawing Sheets

METHOD AND APPARATUS FOR INFERRING THE ACTUAL AIR CHARGE IN AN INTERNAL COMBUSTION ENGINE DURING TRANSIENT CONDITIONS

BACKGROUND OF THE INVENTION

The present invention generally relates to an internal combustion engine having a mass airflow based control system and, more particularly, to such a mass airflow based control system which is capable of predicting cylinder air charge values during transient conditions.

Internal combustion engines having mass airflow based control systems are known in the prior art. Such systems typically include a mass airflow sensor located in the engine induction passage upstream from the throttle valve and the intake manifold. The airflow sensor serves to generate signals related to the air mass flow passing through the induction passage.

When a sudden change in throttle valve position occurs, a sudden change likewise occurs in the air mass flow passing through the induction passage, the air pressure within the manifold, and the air mass flow inducted into the cylinders. For example, when the position of the throttle valve changes from a substantially closed position to a substantially opened position, indicating that the operator is demanding maximum torque, a sudden increase in the amount of air mass flow passing through the induction passage occurs. Increases in the air mass flow passing into the cylinders and the pressure within the intake manifold also occur.

When the throttle valve position suddenly changes to allow more air to pass through the induction passage, a period of rapid transition occurs during which the air mass flow passing through the induction passage exceeds that of the air mass flow inducted into the cylinders. The excess air passing through the induction passage but not going into the cylinders remains in the intake manifold causing an increase in manifold air pressure. However, after a steady state condition is reached, the air mass flow passing through the induction passage is substantially equal to the air mass flow passing into the cylinders.

Prior art mass airflow based control systems control the air/fuel ratio based, at least in part, upon cylinder air mass flow values. Those control systems do not directly sense the air mass flow passing into the cylinders, but approximate same from sensed induction passage air mass flow values. However, during non-steady state periods, when the air mass flow passing through the induction passage is not equal to the air mass flow passing into the cylinders, errors occur in the approximation of the air mass flow passing into the cylinders. Attempts have been made in the past to accurately approximate cylinder air mass flow values during non-steady state periods, but those attempts have generally not been successful.

Cylinder air charge values, which are derived from cylinder air mass flow values, have also been employed by prior art mass airflow based control systems in controlling the air to fuel ratio. Attempts have likewise been made in the past to accurately approximate cylinder air charge values during non-steady state periods, but those attempts have also been generally unsuccessful.

Accordingly, there is a need for an internal combustion engine having an improved mass airflow based control system which is capable of accurately approximating either cylinder air mass flow or cylinder air charge values during non-steady state periods.

SUMMARY OF THE INVENTION

In accordance with the present invention, an improved mass airflow based control system for an internal combustion engine is provided which is capable of accurately approximating cylinder air charge values during non-steady state periods. In accordance with a further embodiment of the present invention, an improved mass airflow based control system is provided which is capable of accurately approximating cylinder air mass flow values during non-steady state periods.

In accordance with one aspect of the present invention, a method is provided for controlling the operation of an internal combustion engine having an airmeter. The method comprises the steps of: measuring the rotational speed of the engine; measuring air mass flow past the airmeter; measuring the temperature of the air entering the engine; measuring the temperature of a coolant circulating through the engine; determining barometric pressure surrounding the engine; inferring a cylinder air charge value based upon the measured rotational speed of the engine, the measured air mass flow, the measured air temperature, the measured coolant temperature, and the determined barometric pressure; and, controlling the operation of the engine by employing the inferred cylinder air charge value.

The step of inferring a cylinder air charge value comprises the step of determining a value of air charge inducted into the engine based upon the measured air mass flow. The step of inferring a cylinder air charge value further comprises the steps of: determining a current filling coefficient value at the measured air temperature and the measured coolant temperature; saving a previously determined filling coefficient value; saving a previously determined cylinder air charge value; and solving the following equation:

$$Mc = K*Ca + [(K/K_o)*(1-K)*Mc_o]$$

wherein:

- Mc is the inferred cylinder air charge value;
- K is the current filling coefficient value;
- $K_o$ is the previously determined filling coefficient value;
- Ca is the value of air charge inducted into the engine; and
- $Mc_o$ is the previously determined cylinder air charge value.

As will be discussed more explicity below, the previously determined filling coefficient value is set equal to the current filling coefficient value and the previously determined cylinder air charge value is set equal to the value of air charge inducted into the engine when the engine speed is less than 200 RPM.

The step of determining a current filling coefficient value at the measured air temperature and the measured coolant temperature comprises the steps of: storing first predetermined data comprising filling coefficient correction values at different air and coolant temperatures; deriving from the first predetermined data a filling coefficient correction value at the measured air temperature and the measured coolant temperature; and, solving the following equation:

$$K=(Temp\ Cor)/\{[(B0+B1*N+B2*N^2)(BP/29.92)/-Mc_o+B3]*Vm*8.497\times10^{-5}\}$$

wherein:

Temp Cor is the derived filling coefficient correction value at the measured air temperature and the measured coolant temperature;

B0, B1, B2, and B3 are regression coefficients;

N is the measured rotational speed of the engine;

BP is the determined barometric pressure;

$Mc_o$ is the previously determined cylinder air charge value; and

Vm is the volume of the engine manifold.

Further provided is an internal combustion engine control system for carrying out the aforementioned method for inferring cylinder air charge.

In accordance with a second aspect of the present invention, a method is provided for controlling the operation of an internal combustion engine. The method comprises the steps of: measuring the rotational speed of the engine; measuring air mass flow inducted into the engine; measuring the temperature of the air entering the engine; measuring the temperature of a coolant circulating through the engine; determining barometric pressure surrounding the engine; inferring a cylinder air mass flow value based upon the measured rotational speed of the engine, the measured air mass flow inducted into the engine, the measured air temperature, the measured coolant temperature, and the determined barometric pressure; and, controlling the operation of the engine by employing the inferred air mass flow value.

The step of inferring a cylinder air mass flow value comprises the steps of: determining a current filling coefficient value at the measured air temperature and the measured coolant temperature; saving a previously determined filling coefficient value; saving a previously determined air mass flow value; and solving the following equation:

$$Ma=K*F+[(K/K_o)*(1-K)*Ma_o]$$

wherein:

Ma is the inferred cylinder air mass flow value;

K is the current filling coefficient value;

$K_o$ is the previously determined filling coefficient value;

F is the value of air mass flow inducted into the engine; and $Ma_o$ is the previously determined cylinder air mass flow value.

The step of determining a current filling coefficient value at the measured air temperature and the measured coolant temperature comprises the steps of: storing first predetermined data comprising filling coefficient correction values at different air and coolant temperatures; deriving from the first predetermined data a filling coefficient correction value at the measured air temperature and the measured coolant temperature; and, solving the following equation:

$$K=(Temp\ Cor)/\{[(B0+B1*N+B2*N^2)(BP/29.92)/(Ma_o/(-N*Y/2))+B3]*Vm*8.497\times10^{-5}\}$$

wherein:

Temp Cor is the filling coefficient correction value at the measured air temperature and the measured coolant temperature;

B0, B1, B2, and B3 are regression coefficients;

N is the measured rotational speed of the engine;

BP is the determined barometric pressure;

$Ma_o$ is the previously determined cylinder air mass flow value;

Vm is the volume of the engine manifold; and

Y is the number of cylinders in the engine.

Additionally provided is an internal combustion engine control system for carrying out the aforementioned method for inferring cylinder air mass flow.

DETAILED DESCRIPTION OF THE INVENTION

Figure 1:
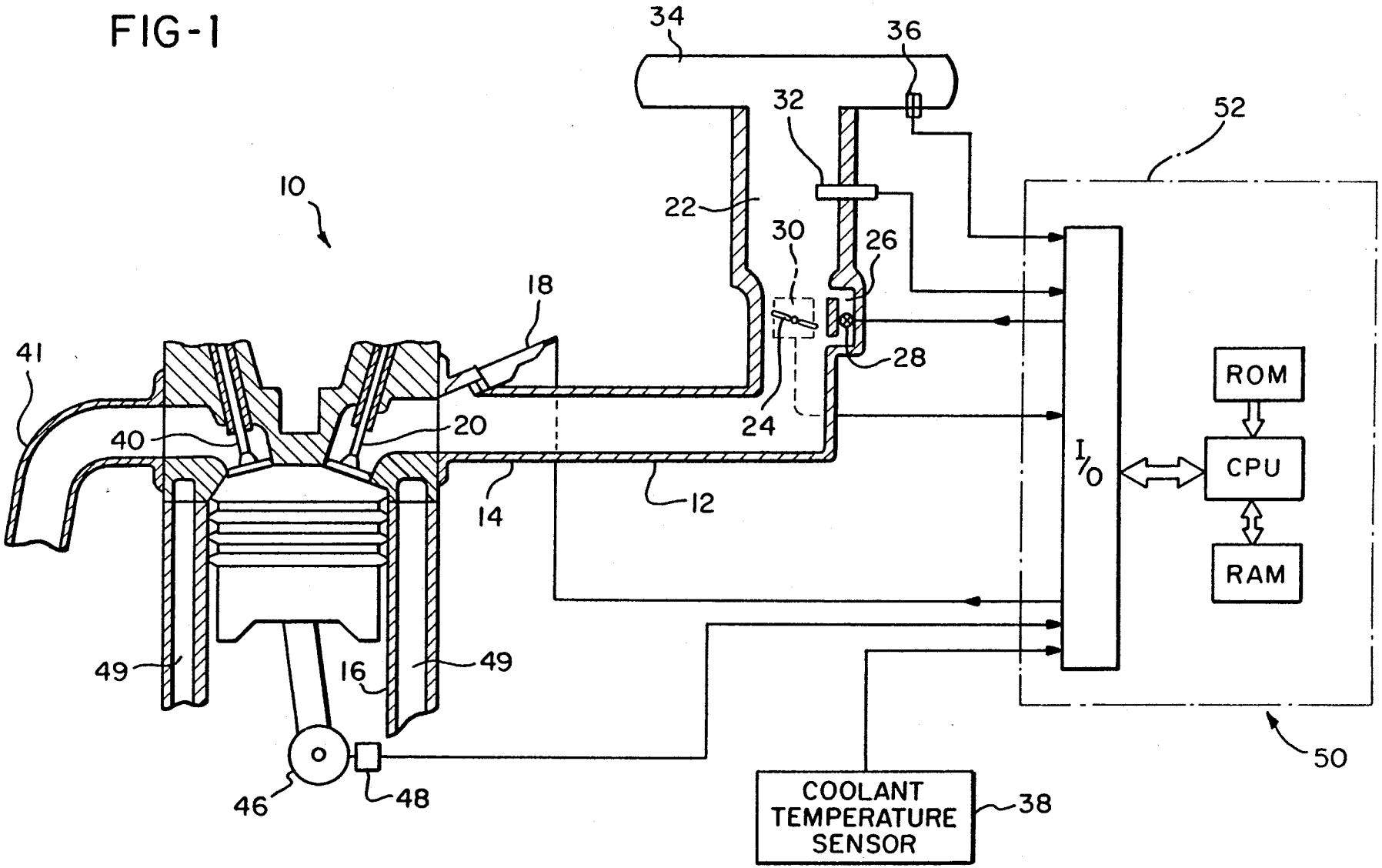
FIG. 1 shows an internal combustion engine system to which the embodiments of the present invention are applied.

FIG. 1 shows schematically in cross-section an internal combustion engine 10 to which an embodiment of the present invention is applied. The engine 10 includes an intake manifold 12 having a plurality of ports or runners 14 (only one of which is shown) which are individually connected to a respective one of a plurality of cylinders or combustion chambers 16 (only one of which is shown) of the engine 10. A fuel injector 18 is coupled to each runner 14 near an intake valve 20 of each respective chamber 16. The intake manifold 12 is also connected to an induction passage 22 which includes a throttle valve 24, a bypass passage 26 which leads around the throttle valve 24 for, inter alia, idle control, and an air bypass valve 28. A position sensor 30 is operatively connected with the throttle valve 24 for sensing the angular position of the throttle valve 24. The induction passage 22 further includes a mass airflow sensor 32, such as a hot-wire air meter. The induction passage 22 also has mounted at its upper end an air cleaner system 34 which, in the illustrated embodiment, includes an inlet air temperature sensor 36. Alternatively, the air temperature sensor 36 could be mounted within the intake manifold 12.

The engine 10 further includes an exhaust manifold 41 connected to each combustion chamber 16. Exhaust gases generated during combustion in the chambers 16 are released to atmosphere via an exhaust valve 40 and the exhaust manifold 41.

Operatively connected to the crankshaft 46 of the engine 10 is a crank angle detector 48 which detects the rotational speed (N) of the engine 10. The engine 10 further includes an engine coolant system 49 which has associated therewith an engine coolant temperature sensor 38.

In accordance with the present invention, a mass airflow based control system 50 is provided which, inter alia, is capable of inferring cylinder air charge values. The system includes a control unit 52 which preferably comprises a microcomputer. The control unit 52 is arranged to receive inputs from the mass airflow sensor 32, the inlet air temperature sensor 36, the engine coolant temperature sensor 38, and the crank angle detector 48 via an I/O interface. A read only memory (ROM) of the microcomputer stores various operating steps and predetermined data. As will be discussed in further detail below, by employing the stored steps, the predetermined data, and the inputs described above, the control unit 52 is capable of inferring cylinder air charge.

It is noted that the control system 50 additionally functions to control, inter alia, the ignition control system (not shown), the fuel injection system including injectors 18, and the duty cycle of the air bypass valve 28.

Equations employed by the control unit 52 in accordance with the present invention for inferring cylinder air charge will now be described, Cylinder air charge is defined by the following manifold filling model:

$$Mc(i)=k(i)*Ca(i)+[Veff(i)/Veff(i-1)]*[1-k(i)]*Mc(i-1) \quad (1)$$

wherein:

Mc is a cylinder air charge;

$$k(i)=[\tfrac{1}{2}]*[Vd/vm]*N(i)*Veff(i)*\Delta t; \quad (2)$$

Vd is the engine displacement;

Vm is the manifold volume which is defined as the volume extending from the throttle valve 24 to the intake valves 20;

N is the engine speed in RPM;

Veff=volumetric efficiency;

Δt is the sample time, preferably the time between firing events;

Ca is the air charge passing through the induction passage 22.

Volumetric efficiency is defined as follows:

$$Veff=Mc/AC_t \quad (3)$$

wherein:

Mc is the actual cylinder air charge at a manifold air pressure MAP; and $AC_t$ is the theoretical cylinder air charge if cylinders were filled with air at manifold air pressure MAP.

In order to determine $AC_t$, manifold air pressure (MAP) must be determined. An equation used to determine MAP will now be developed.

Figure 2:
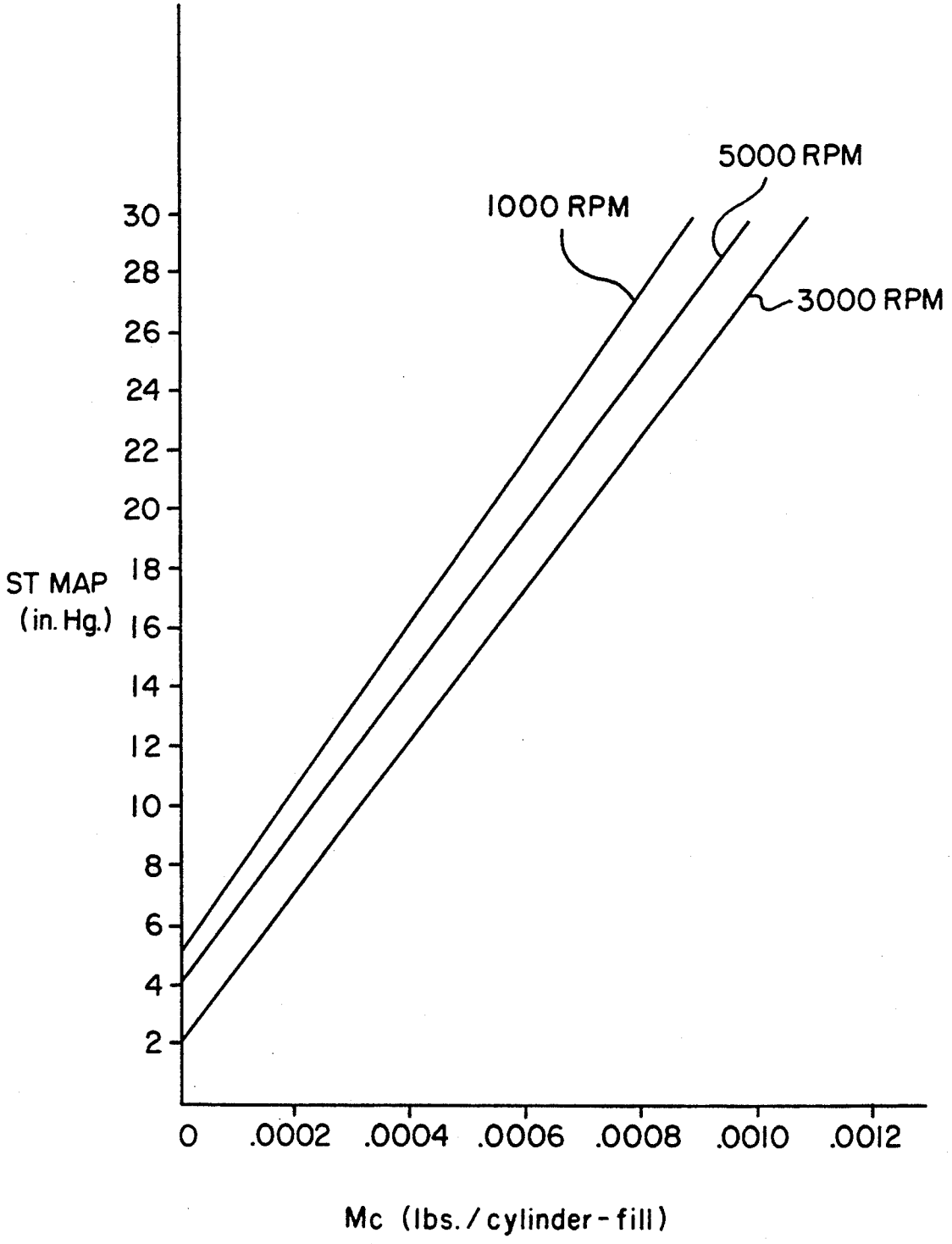
FIG. 2 is a graph showing STMAP vs. air charge at various RPM values.

It has been found that during steady-state conditions cylinder air charge is essentially linear with manifold air pressure (MAP) at a given engine speed (N). Accordingly, for a given engine design, values for MAP, N, and cylinder air charge are collected under steady-state conditions at a standard barometric pressure and temperature (e.g., 29.9 in.Hg. and 100° F.) and plotted, as shown in the example plot of FIG. 2. From that plot, the following equation is developed using a well-known least squares linear regression technique:

$$STAMP=(B0+B1*N+B2*N^2)+B3*Mc$$

wherein:

STMAP is manifold air pressure at a standard barometric pressure and temperature;

N is the engine speed in RPM;

Mc is the cylinder air charge; and

B0, B1, B2, B3 are engine design specific regression coefficients.

In order to determine a manifold air pressure (MAP) value at any given barometric pressure, the equation for STMAP is corrected for changes in barometric pressure from the standard value. This equation is as follows:

$$MAP=[(B0+B1*N+B2*N^2)(BP/29.92)]+B3*Mc \quad (4)$$

wherein:

MAP is the manifold air pressure at a given barometric pressure (BP);

BP is barometric pressure (in.Hg.);

29.92 is the standard barometric pressure (in.Hg.);

N is the engine speed in RPM;

Mc is the cylinder air charge; and

B0, B1, B2, B3 are the regression coefficients.

In accordance with another embodiment of the present invention, MAP is determined from an equation and two look-up tables. The first look-up table is recorded in terms of RPM, the input, and ΔSTMAP/ΔMc, the output. The second look-up table is recorded in terms of RPM, the input, and STMAP, the output. Values for Mc, STMAP and N, which are used to create the two look-up tables, are collected under steady-state conditions at a standard barometric pressure and temperature and plotted, as shown in the example plot of FIG. 2. Using the outputs from the two look-up tables, the value for MAP is determined from the following equation:

$$MAP=[(STMAP)(BP/29.92)]+(\Delta STMAP/\Delta Mc)*(Mc)$$

wherein:

ΔSTMAP/ΔMc is the output from the first look-up table;

STMAP is the output from the second look-up table;

BP is barometric pressure (in.Hg.);

29.92 is the standard barometric pressure (in.Hg.); and

Mc is the cylinder air charge.

The value $AC_t$ (lbs./cylinder-fill), which is defined as theoretical air charge if cylinders were filled with air at MAP, is determined from the following equation:

$$AC_t = (Vd \text{ liters/engine}) * (.03531 \text{ ft}^3\text{/liter}) * (1 \text{ engine}/Y) * (.072 \text{ lbsm air/ft}^3 @560° \text{ R., } 29.92 \text{ in.Hg.}) * (MAP) / (29.92 \text{ in.Hg.}) \quad (5)$$

$$AC_t = MAP * (Vd/Y) * 8.497 \times 10^{-5}$$

wherein:

Vd is the engine displacement;

Y is the number of cylinders in the engine 10;

0.072 lbsm air/ft$^3$ is the density of air at 560° R. and 29.92 in.Hg.;

MAP is manifold air pressure at a given barometric pressure (BP); and 29.92 (in.Hg.) is the standard barometric pressure.

Substituting equation (5) into the denominator of equation (3), Veff, which is volumetric efficiency at the base air charge temperature (100° F.) and base engine coolant temperature (200° F.), becomes:

$$Veff_b=Mc/MAP*(Vd/Y)*8.497\times10^{-5}$$

Substituting equation (4) for MAP, $Veff_b$ becomes:

$$Veff_b=Mc/\{[(B0+B1*N+B2*N^2)(BP/29.92)+B3*Mc]*(Vd/Y)*8.497\times10^{-5}\{ \quad (6)$$

In order to determine volumetric efficiency Veff at the actual air charge temperature and engine coolant temperature, $Veff_b$ must be corrected by a value defined as "Temp Cor".

Before "Temp Cor" is defined, some required definitions will now be set out.

Actual engine displacement is defined by the following equation:

$$Vd=\pi*(Bore/2)^2*Stroke*Y$$

wherein:

Vd is the engine displacement;

$\pi=3.14159$;

Bore is the diameter of cylinder 16;

Stroke is the length of cylinder swept as the crankshaft 46 rotates; and

Y is the number of cylinders in the engine 10.

DRYMAP is defined by the following equation:

$$DRYMAP=MAP-Specific\ Humidity(grains/lbm)/149.8(grains/lbm)/(in.Hg.)$$

wherein:

MAP is the manifold air pressure;

Specific Humidity = grains of vapor/pound mass of dry air; and 149.8 is a constant for converting Specific Humidity to its partial pressure in in.Hg.

Theoretical air charge at MAP for 1 cylinder is defined by the following equation:

$$THAIRCHG=(Vd/Y)*(DRYMAP/29.92)*(0.072\ lbsm\ air/ft^3)*(560°\ R/T_a)$$

wherein:

Vd is the engine displacement;

Y is the number of cylinders in the engine 10;

DRYMAP = MAP − Specific Humidity/149.8;

29.92 (in.Hg.) is the standard barometric pressure;

0.072 lbsm air/$ft^3$ is the density of air at 560° R. and 29.92 in.Hg.;

560° R. is the standard air temperature; and $T_a$ is the temperature of the air entering the induction passage 22 as measured by the inlet air temperature sensor 36.

Observed volumetric efficiency is defined by the following equation:

$$Veff_o=Mc_s/THAIRCHG$$

$Mc_s$ is cylinder air charge during steady-state conditions and is determined from the equation:

$$Mc_s=F/(N*Y/2)$$

wherein:

F is the air mass flow value measured during steady-state conditions;

N is the engine speed in RPM; and

Y is the number of cylinders in the engine 10.

Volumetric efficiency during steady-state conditions and at the base air charge temperature (100° F.) and base engine coolant temperature (200° F.) is defined by the following equation:

$$Veff_{bs}=Mc_s/\{[(B0+B1*N+B2*N^2)(BP/29.92)+B3*Mc_s]*(Vd/Y)*8.497\times10^{-5}\}.$$

Temp Cor is defined by the following equation:

$$Temp\ Cor=Veff_o/Veff_{bs} \quad (6)$$

Figure 3:
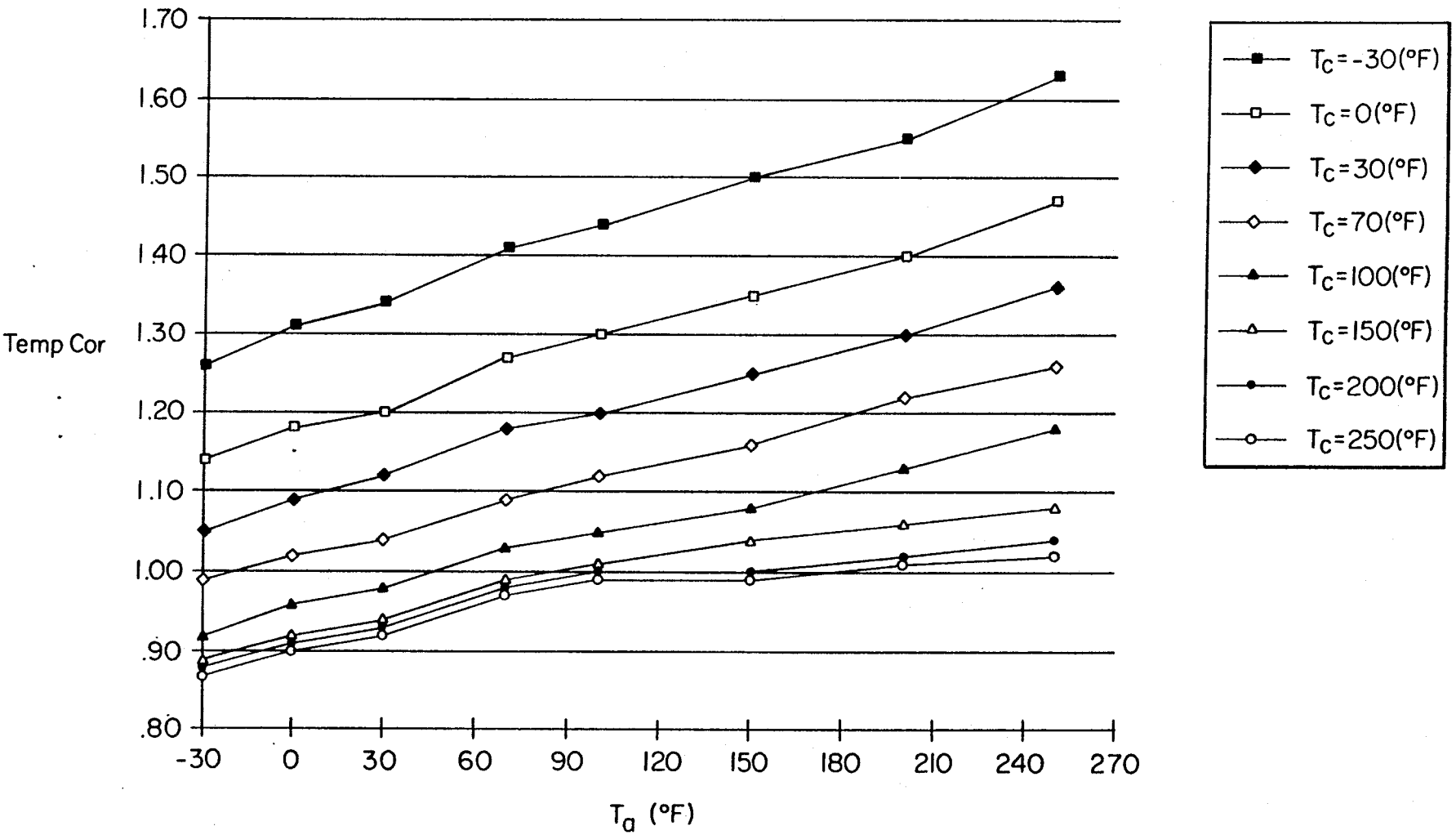
FIG. 3 is a graphical representation of a look-up table recorded in terms of Temp Cor, inlet air temperature, and engine coolant temperature; and, FIG. 4 is a flow chart depicting steps which are employed to infer cylinder air charge.

Values for Temp Cor are determined from equation (6) at different inlet air temperature ($T_a$) and engine coolant temperature ($T_c$) values and plotted, as shown in the example plot of FIG. 3. The control unit 52 contains a look-up table recorded in terms of $T_a$ and $T_c$, the inputs, and Temp Cor, the output. Temp Cor is also referred to herein as a filling coefficient correction value.

Volumetric efficiency Veff at the actual air charge temperature and engine coolant temperature is defined by the following equation:

$$Veff=(Temp\ Cor)(Mc)/\}[(B0+B1*N+B2*N^2)(BP/29.92)+B3*Mc]*(Vd/Y)*8.497\times10^{-5}\} \quad (7)$$

The manner in which the filling coefficient value k is determined will now be described. Δt is defined as the time between firing events and is found from the following equation:

$$\Delta t=2.0/(N*Y) \quad (8)$$

wherein:

N is the engine speed in RPM; and

Y is the number of cylinders in the engine 10.

Substituting equation (8) into equation (2), k becomes:

$$K=(1/Y)*(Vd/Vm)*Veff \quad (9)$$

Since Y, Vd and Vm are known for a given engine, K is proportional to Veff. Substituting equation (7) into equation (9), and setting $Mc=Mc_o$, a previously determined value for Mc (this approximation is done in order to allow K to be used in determining an inferred value for Mc, as will be set out below), K becomes:

$$K=(Temp\ Cor)/\{[(B0+B1*N+B2*N^2)(BP/29.92)/-Mc_o+B3]*Vm*8.497\times10^{-5}\} \quad (10)$$

Variables $Z_a$ and $Z_b$ are defined as follows:

$$Z_a=(B0+B1.N+B2.N^2)(BP/29.92);\ \text{and}$$

$$Z_b=[1/(Vm*8.497\times10^{-5})]*Temp\ Cor$$

Substituting variables $Z_a$ and $Z_b$ into equation (10), K becomes:

$$K=Z_b/[(Z_a/Mc_o)+B3] \quad (11)$$

Since K is proportional to Veff and $K_o$ is proportional to Veff(i−1), K (i.e., the current value for K) and $K_o$ (i.e., the previously determined value for K) are substituted into equation (1) for Veff(i) and Veff(i−1), respectively, and Mc becomes:

$$MC=K*Ca+[(K/K_o)*(1-K)*Mc_o] \quad (12)$$

Figure 4:
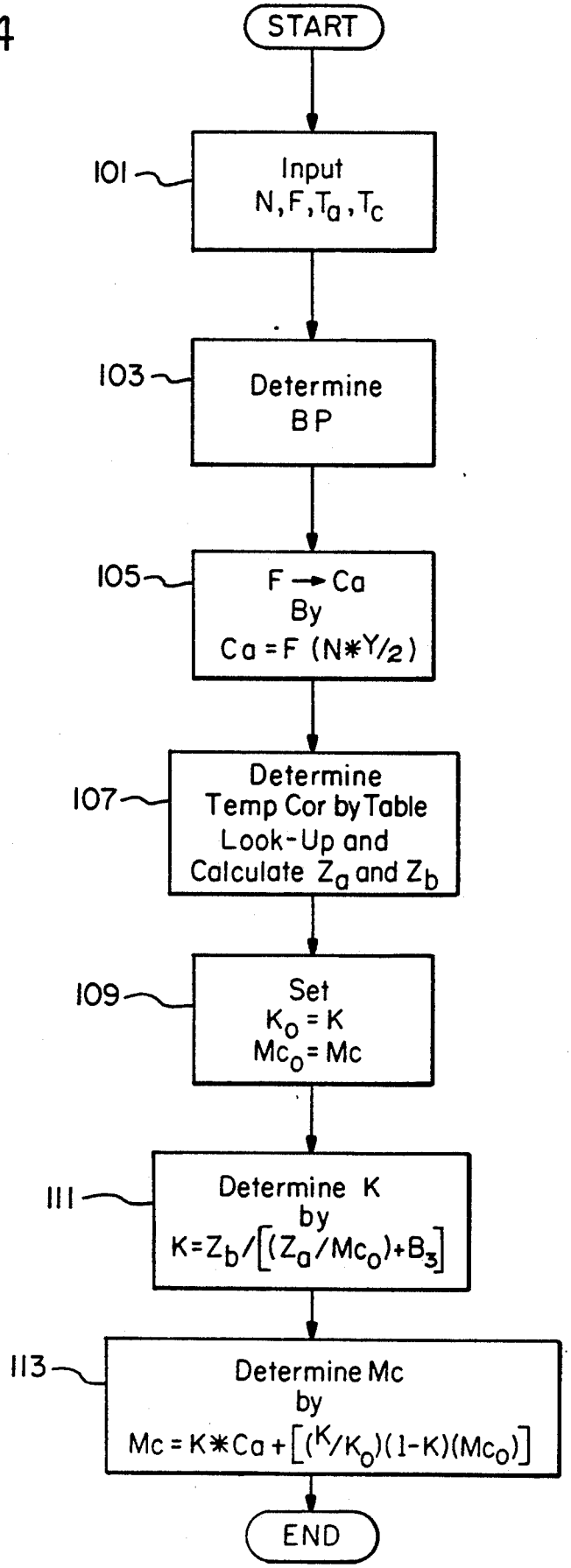

With reference to FIG. 4, an explanation now follows describing the manner in which the control unit 52 infers cylinder air charge Mc.

The first step 101 is to sample input signals from each of the following sensors: the crank angle detector 48 to determine the engine speed N (RPM); the mass airflow sensor 32 to obtain the value F (pounds/minute), which is equal to the air mass flow passing through the induction passage 22; the inlet air temperature sensor 36 to obtain the value $T_a$, which is representative of the temperature of the air entering the induction passage 22 of the engine 10; and the engine coolant temperature sensor 38 to obtain the value $T_c$, which is representative of the temperature of the coolant circulating through the engine 10.

In step 103, barometric pressure (BP) is either directly measured by a barometer (not shown) or inferred in the manner as described in commonly assigned U.S. Pat. No. 5,136,517, the disclosure of which is incorporated herein by reference.

In step 105, the value F is employed to obtain the value Ca, which is equal to the air charge (pounds/cylinder-fill) passing through the induction passage 22, using the following equation:

$$Ca=F/(N*Y/2)$$

wherein:

Ca is the air charge passing through the induction passage 22 (lbs./cylinder-fill);

F is the value input from the mass airflow sensor 32;

N is the engine speed in RPM; and

Y is the number of cylinders in the engine 10.

In step 107, Temp Cor is determined from the look-up table recorded in terms of $T_a$, $T_c$ and Temp Cor, and variables $Z_a$ and $Z_b$ are calculated.

In step 109, except during engine cranking, previously determined values for K and Mc are saved as follows:

$K_o=K$; and $Mc_o=Mc$.

When the engine 10 is cranking, i.e., $N<200$ RPM, $Mc_o$ is set equal to Ca, and $K_o$ is left unassigned until step 111. In step 111, $K_o$ is set equal to the value of K determined in that step.

In step 111, a new value for K is determined via equation (11). During cranking, $K_o$ is set equal to this new value of K.

In step 113, a new value for Mc is determined via equation (12). As noted previously, when the engine is cranking, $K_o$ is set equal to the current value of K, as determined in step 111, and $Mc_o$ is set equal to Ca. Thus, during cranking $K/K_o=1$.

The control unit 52 preferably samples inputs from the mass airflow sensor 32 and the crank angle detector 48 once every engine firing event. The control unit 52 also performs steps 105 and 109–113 once every firing event. In order to reduce the number of functions performed by the control unit 52, inputs from the inlet air temperature sensor 36 and the engine coolant temperature sensor 38 may be sampled less often than once every firing event. Further, the determination of barometric pressure recited in step 103, and the determination of $Z_a$ and $Z_b$ recited in step 107, may be performed less often than once every firing event.

The control unit 52 employs the cylinder air charge value Mc found from equation (12) to schedule the proper fuel flow from the injectors 18 into the cylinders 16 to achieve the desired air/fuel ratio; thereby improving fuel economy, performance and emissions. Furthermore, where a cylinder air charge value is used to control other engine operating parameters, such as spark advance, it is apparent that the cylinder air charge value determined in accordance with the present invention can be used for such purposes.

In accordance with another embodiment of the present invention, the control unit 52 infers cylinder air mass flow values rather than cylinder air charge values. In equation (1), the parameter Ca is replaced with the value F, which is equal to the air mass flow passing through the induction passage 22, and Mc is replaced by Ma, which is the value of inferred cylinder air mass flow. Further, MAP, volumetric efficiency, and Temp Cor are preferably derived in terms of air mass flow (lbs./min.) rather than in terms of air charge. The control unit 52 infers cylinder air mass flow from the following equation:

$$Ma=K*F+[(K/K_o)*(1-K)*Ma_o] \quad (13)$$

wherein:

$$K=(Temp\ Cor)/\{[(B0+B1*N+B2*N^2)(BP/29.92)/(Ma_o/(N*Y/2))+B3]*Vm*8.497\times10^{-5}\};$$

F is the air mass flow value measured by the airmeter 32;

$K_o$ is the previously determined value of K (as with the first embodiment, $K_o$ is set equal to the current value of K during engine cranking); and $Ma_o$ is the previously determined value of Ma (during engine cranking $Ma_o$ is set equal to F).

The cylinder air mass flow value Ma found from equation (13) is employed by the control unit 52 to schedule the proper fuel flow from the injectors 18 into the cylinders 16 to achieve the desired air/fuel ratio.

Having described the invention in detail and by reference to preferred embodiments thereof, it will be apparent that modifications and variations are possible without departing from the scope of the invention as defined in the appended claims.

What is claimed is:

1. A method for controlling the operation of an internal combustion engine comprising the steps of:

measuring the rotational speed of said engine;

measuring air mass flow being inducted into said engine;

measuring the temperature of the air entering said engine;

measuring the temperature of a coolant circulating through said engine;

determining barometric pressure surrounding said engine;

inferring a cylinder air charge value based upon said measured rotational speed of said engine, said measured air mass flow, said measured air temperature, said measured coolant temperature, and said determined barometric pressure; and controlling the operation of said engine by employing said inferred cylinder air charge value.

2. A method as set forth in claim 1, wherein said step of inferring a cylinder air charge value comprises the step of determining a value of air charge inducted into said engine based upon said measured air mass flow.

3. A method as set forth in claim 2, wherein said step of inferring a cylinder air charge value further comprises the steps of:

determining a current filling coefficient value at said measured air temperature and said measured coolant temperature;

saving a previously determined filling coefficient value;

saving a previously determined cylinder air charge value; and solving the following equation:

$$MC=K*Ca+[(K/K_o)*(1-K)*Mc_o]$$

wherein:

Mc is the inferred cylinder air charge value;

K is the current filling coefficient value;

$K_o$ is said previously determined filling coefficient value;

Ca is said value of air charge inducted into said engine; and $Mc_o$ is said previously determined cylinder air charge value.

4. A method as set forth in claim 3, wherein said previously determined filling coefficient value is set equal to said current filling coefficient value and said previously determined cylinder air charge value is set equal to said value of air charge inducted into said engine when said engine speed is less than 200 RPM.

5. A method as set forth in claim 3, wherein said step of determining a current filling coefficient value at said measured air temperature and said measured coolant temperature comprises the steps of:

storing first predetermined data comprising filling coefficient correction values at different air and coolant temperatures;

deriving from said first predetermined data a filling coefficient correction value at said measured air temperature and said measured coolant temperature; and solving the following equation:

$$K=(Temp\ Cor)/\{[(B0+B1*N+B2*N^2)(BP/29.92)/-Mc_o+B3]*Vm*8.497\times10^{-5}\}$$

wherein:

Temp Cor is said derived filling coefficient correction value at said measured air temperature and said measured coolant temperature;

B0, B1, B2, and B3 are regression coefficients;

N is said measured rotational speed of said engine;

BP is said determined barometric pressure;

$Mc_o$ is said previously determined cylinder air charge value; and

Vm is the volume of the engine manifold.

6. A method as set forth in claim 1, wherein said step of determining barometric pressure surrounding said engine comprises the step of measuring said barometric pressure with a barometer.

7. A method as set forth in claim 1, wherein said step of determining barometric pressure surrounding said engine comprises the step of inferring said barometric pressure.

8. A method as set forth in claim 5, wherein $$Z_a=(B0+B1*N+B2*N^2)(BP/29.92) \text{ and}$$

$$Z_b=[1/(Vm*8.497\times10^{-5})]*Temp\ Cor, \text{ and}$$

$Z_a$ and $Z_b$ are determined less often than once every firing event.

9. A system for controlling the operation of an internal combustion engine comprising:

means for measuring the rotational speed of said engine;

means for measuring air mass flow inducted into said engine;

means for measuring the temperature of the air entering said engine;

means for measuring the temperature of a coolant circulating through said engine;

means for determining barometric pressure surrounding said engine;

processor means for sampling inputs from said means for measuring the rotational speed of said engine, said means for measuring air mass flow, said means for measuring air temperature, said means for measuring coolant temperature, and said means for determining barometric pressure, and for inferring a cylinder air charge value based upon said inputs; and said processor means further controlling the operation of said engine by employing said inferred cylinder air charge value.

10. A system as set forth in claim 9, wherein said processor means determines a value of air charge inducted into said engine based upon said measured air mass flow.

11. A system as set forth in claim 10, wherein said processor means further determines a current filling coefficient value at said measured air temperature and said measured coolant temperature, saves a previously determined filling coefficient value, saves a previously determined cylinder air charge value, and infers said cylinder air charge value by solving the following equation:

$$Mc=K*Ca+[(K/K_o)*(1-K)*Mc_o]$$

wherein:

Mc is the inferred cylinder air charge value;

K is the current filling coefficient value;

$K_o$ is said previously determined filling coefficient value;

Ca is said value of air charge inducted into said engine; and $Mc_o$ is said previously determined cylinder air charge value.

12. A system as set forth in claim 11, wherein said processor means sets said previously determined filling coefficient value equal to said current filling coefficient value and sets said previously determined cylinder air charge value equal to said value of air charge inducted into said engine when said engine speed is less than 200 RPM.

13. A system as set forth in claim 11, wherein said processor means includes memory means for storing first predetermined data comprising filling coefficient correction values at different air and coolant temperatures.

14. A system as set forth in claim 13, wherein said processor means further derives from said first predetermined data a filling coefficient correction value at said measured air temperature and said measured coolant temperature, and determines said current filling coefficient value by solving the following equation:

$$K=(Temp\ Cor)/\{[(B0+B1*N+B2*N^2)(BP/29.92)/Mc_o+B3]*Vm*8.497\times10^{-5}\}$$

wherein:

Temp Cor is the derived filling coefficient correction value at said measured air temperature and said measured coolant temperature;

B0, B1, B2, and B3 are regression coefficients;

N is said measured rotational speed of said engine;

BP is said determined barometric pressure;

$Mc_o$ is said previously determined cylinder air charge value; and

Vm is the volume of the engine manifold.

15. A system as set forth in claim 9, wherein said processor means samples inputs from said means for measuring the rotational speed of said engine and said means for measuring air mass flow once every engine firing event and samples inputs from said air temperature measuring means, said coolant temperature measuring means and said means for determining barometric pressure less often than once every firing event.

16. A method for controlling the operation of an internal combustion engine comprising the steps of:

measuring the rotational speed of said engine;

measuring air mass flow inducted into said engine;

measuring the temperature of the air entering said engine;

measuring the temperature of a coolant circulating through said engine;

determining barometric pressure surrounding said engine;

inferring a cylinder air mass flow value based upon said measured rotational speed of said engine, said measured air mass flow inducted into said engine, said measured air temperature, said measured coolant temperature, and said determined barometric pressure; and controlling the operation of said engine by employing said inferred air mass flow value.

17. A method as set forth in claim 16, wherein said step of inferring a cylinder air mass flow value comprises the steps of:

determining a current filling coefficient value at said measured air temperature and said measured coolant temperature;

saving a previously determined filling coefficient value;

saving a previously determined air mass flow value; and solving the following equation:

$$Ma=K*F+[(K/K_o)*(1-K)*Ma_o]$$

wherein:

Ma is the inferred air mass flow value;

K is the current filling coefficient value;

$K_o$ is said previously determined filling coefficient value;

F is said value of air mass flow inducted into said engine; and $Ma_o$ is said previously determined cylinder air mass flow value.

18. A method as set forth in claim 17, wherein said previously determined filling coefficient value is set equal to said current filling coefficient value and said previously determined cylinder air mass flow value is set equal to said value of air mass flow inducted into said engine when said engine speed is less than 200 RPM.

19. A method as set forth in claim 17, wherein said step of determining a current filling coefficient value at said measured air temperature and said measured coolant temperature comprises the steps of:

storing first predetermined data comprising filling coefficient correction values at different air and coolant temperatures;

deriving from said first predetermined data a filling coefficient correction value at said measured air temperature and said measured coolant temperature; and solving the following equation:

$$K=(Temp\ Cor)/\{[(B0+B1*N+B2*N^2)(BP/29.92)/(Ma_o/N*Y/2))+B3]*Vm*8.497\times10^{-5}\}$$

wherein:

Temp Cor is said filling coefficient correction value at said measured air temperature and said measured coolant temperature;

B0, B1, B2, and B3 are regression coefficients;

N is said measured rotational speed of said engine;

BP is said determined barometric pressure;

$Ma_o$ is said previously determined cylinder air mass flow value;

Vm is the volume of the engine manifold; and

Y is the number of cylinders in said engine.

20. A method as set forth in claim 16, wherein said step of determining barometric pressure surrounding said engine comprises the step of measuring said barometric pressure with a barometer.

21. A method as set forth in claim 16, wherein said step of determining barometric pressure surrounding said engine comprises the step of inferring said barometric pressure.

* * * * *